US005199915A

United States Patent [19]

Bindon et al.

[11] Patent Number: 5,199,915

[45] Date of Patent: Apr. 6, 1993

[54] FOOTPIECE FOR A SKI

[76] Inventors: Jeffery P. Bindon, 11 Edinburgh Crescent, Westville, Natal Province; Hilton R. Thorpe, 366 Bartle Road, Umbilo, Natal Province, both of South Africa

[21] Appl. No.: 664,257

[22] Filed: Mar. 1, 1991

[30] Foreign Application Priority Data

Mar. 2, 1990 [ZA] South Africa ..... 90/1620

[51] Int. Cl.[5] ..... B63B 35/81

[52] U.S. Cl. ..... 441/70; 280/621

[58] Field of Search ..... 441/70; 280/621, 633

[56] References Cited

U.S. PATENT DOCUMENTS

| | | | |
|---|---|---|---|
| 2,412,474 | 12/1946 | Scott-Paine et al. | 441/70 |
| 3,404,900 | 10/1968 | Rippetoe | 441/70 |
| 3,604,032 | 9/1971 | Kiefer | 441/70 |
| 3,839,758 | 10/1974 | Jack | 441/70 |

FOREIGN PATENT DOCUMENTS

| | | | |
|---|---|---|---|
| 517961 | 11/1955 | Canada | 441/70 |
| 477883 | 3/1928 | Fed. Rep. of Germany | 280/621 |
| 159515 | 4/1940 | Fed. Rep. of Germany | 280/621 |
| 26924 | 2/1915 | Norway | 280/621 |
| 70404 | 2/1941 | Norway | 280/621 |
| 249148 | 6/1947 | Switzerland | 280/621 |

*Primary Examiner*—Sherman Basinger
*Assistant Examiner*—Thomas J. Brahan
*Attorney, Agent, or Firm*—Morgan & Finnegan

[57] ABSTRACT

A footpiece for locating a skier's foot on a ski, particularly a water ski, comprises a foot locating member made up of two foot locating portions. In use, one foot locating portion is fixed to the ski, whereas the other portion is slidingly located relative to the ski, the positional adjustment between the foot locating portions by the sliding displacement of the slidingly located foot locating portion permitting different sized feet of skiers to be snugly received by the foot locating member. A flexible strap engaged with the slidingly located foot locating portion permits displacement of said portion by applying tension to the strap, suitable manipulation of the strap also permitting operation of a locking means for releasably locking the slidingly located foot locating portion in desired positions.

22 Claims, 2 Drawing Sheets

FOOTPIECE FOR A SKI

THIS INVENTION relates to a footpiece for locating a skier's foot on a ski and to a ski incorporating such a footpiece.

The invention relates in particular to water skis and, as such, to a footpiece for locating a skier's foot on a water ski.

According to a first aspect of the invention there is provided a footpiece for locating a skier's foot on a ski, which footpiece includes a foot locating member including a first foot locating portion formed to receive the heel part of a skier's foot therein and a second foot locating portion formed to receive the ball and toe part of a skier's foot therein, one foot locating portion having attachment means for fixedly securing it to the ski, while the other foot locating portion is slidingly located relative to the ski, so that by sliding displacement of the slidingly located foot locating portion different sized skiers' feet can be accommodated by the foot locating member;

guide means for guiding sliding displacement of the slidingly located foot locating portion relative to the ski;

a flexible elongate element coupled to the slidingly located foot locating portion so that a tensile force can be applied to the elongate element, which force can be transmitted to the said foot locating portion for slidingly displacing the said foot locating portion relative to the ski; and locking means for releasably locking the slidingly located foot locating portion in a required position relative to the ski and thus also the fixedly secured foot locating portion.

The footpiece may include also a yoke secured to the slidingly located foot locating portion while the elongate element may be threaded through an engagement opening defined by the yoke, with one end of the element fixedly anchored relative to the ski and the other end of the element being disposed so that by applying a tensile force thereon the slidingly located foot locating portion can be displaced thereby. Alternatively, the footpiece may include a yoke secured to the fixedly secured foot locating portion while the elongate element may be threaded through an engagement opening defined by the yoke, with one end of the element fixedly anchored on the slidingly located foot locating portion and the other end of the elongate element being disposed so that by applying a tensile force thereon the slidingly located foot locating portion can be displaced thereby.

The locking means of the footpiece of the invention may be adapted to lock the slidingly located foot locating portion in a required position relative to the ski by locking the flexible elongate element relative thereto. As such, the locking means may comprise a body portion defining an engaging formation and a cam rotatably mounted on a shaft and having an eccentric formation with respect to the shaft, the configuration between the engaging formation and the eccentric formation of the cam being such that the flexible elongate element can pass between them and by rotation of the cam, the eccentric formation is displaceable between a first angular position in which the elongate element is freely displaceable between the engaging formation and the eccentric formation and a second angular position in which the elongate element is locked between them.

The body portion defining the engaging formation may be part of the fixedly secured foot locating portion and the cam formation may be rotatably mounted on the same foot locating portion. Instead, the body portion defining the engaging formation may form part of the displaceable foot locating portion and the cam formation may be rotatably mounted on the same foot locating portion.

Further according to the invention, the locking means may include a lever fast with the cam for rotating the cam about its shaft. For this configuration of the invention, the lever may have an aperture therethrough through which the flexible elongate element can be threaded so that, in use, the cam can be rotatably displaced between its first and second angular positions by suitable manipulation of the flexible elongate element.

The flexible elongate element may be of any suitable material and, typically, is in the form of an elongate flat strap.

The guide means of the footpiece of the invention may comprise a guide rail that is engaged by the slidingly located foot locating portion via formations defined by the slidingly located foot locating portion that is complementary to the cross-sectional profile of the guide rail. As such, the guide rail may have a T-shaped cross-sectional profile and the slidingly located foot locating portion may define a channel formation having a complementary profile to provide for sliding engagement of the slidingly located foot locating portion with the rail.

According to a second aspect of the invention there is provided a ski comprising a planing body and a footpiece for locating a skier's foot on the planing body, which footpiece includes a foot locating member including a first foot locating portion formed to receive the heel part of a skier's foot therein and a second foot locating portion formed to receive the ball and toe part of a skier's foot therein, one foot locating portion being fixedly secured to the planing body of the ski, while the other foot locating portion is slidingly located relative to the planing body of the ski, so that by sliding displacement of the slidingly located foot locating portion different sized skier's feet can be can be accommodated by the foot locating member;

guide means for guiding sliding displacement of the slidingly located foot locating portion relative to the planing body of the ski;

a flexible elongate element coupled to the slidingly located foot locating portion so that a tensile force can be applied to the elongate element, which force can be transmitted to the said foot locating portion for slidingly displacing the said foot locating portion relative to the planing body of the ski; and locking means for releasably locking the slidingly located foot locating portion in a required position relative to the planing body of the ski and thus also the fixedly secured foot locating portion.

The footpiece of the ski of the invention may include all the features of the footpiece, in accordance with the first aspect of the invention. Furthermore, the ski in accordance with the second aspect of the invention, typically is a water ski.

For use, the method of fitting a ski including a footpiece, in accordance with the first aspect of this invention, to a skier's foot will include the steps of placing the fixedly secured foot locating portion and the slidingly located foot locating portion sufficiently far apart, inserting the foot of the skier into said foot locating portions, gathering in and applying a tensile force to the flexible elongate element so that the slidingly located foot locating portion can be displaced towards the fixedly secured foot locating portion thereby to grip the foot of the user tightly, and releasably locking the flexible elongate element in its tensile state via the locking means.

Clearly, the above method can be carried out by merely manipulating the flexible elongate element with respect to the ski and, as such, a skier can easily secure a ski, and typically a water ski, to his foot, even while floating in water. Also, the release of the skier's foot can be easily effected by the suitable manipulation of the flexible elongate element for releasing its tensile state, through operation of the locking means.

Two non-limiting embodiments of the invention are now described, with reference to the accompanying diagrammatic drawings, in which.

Figure 1:
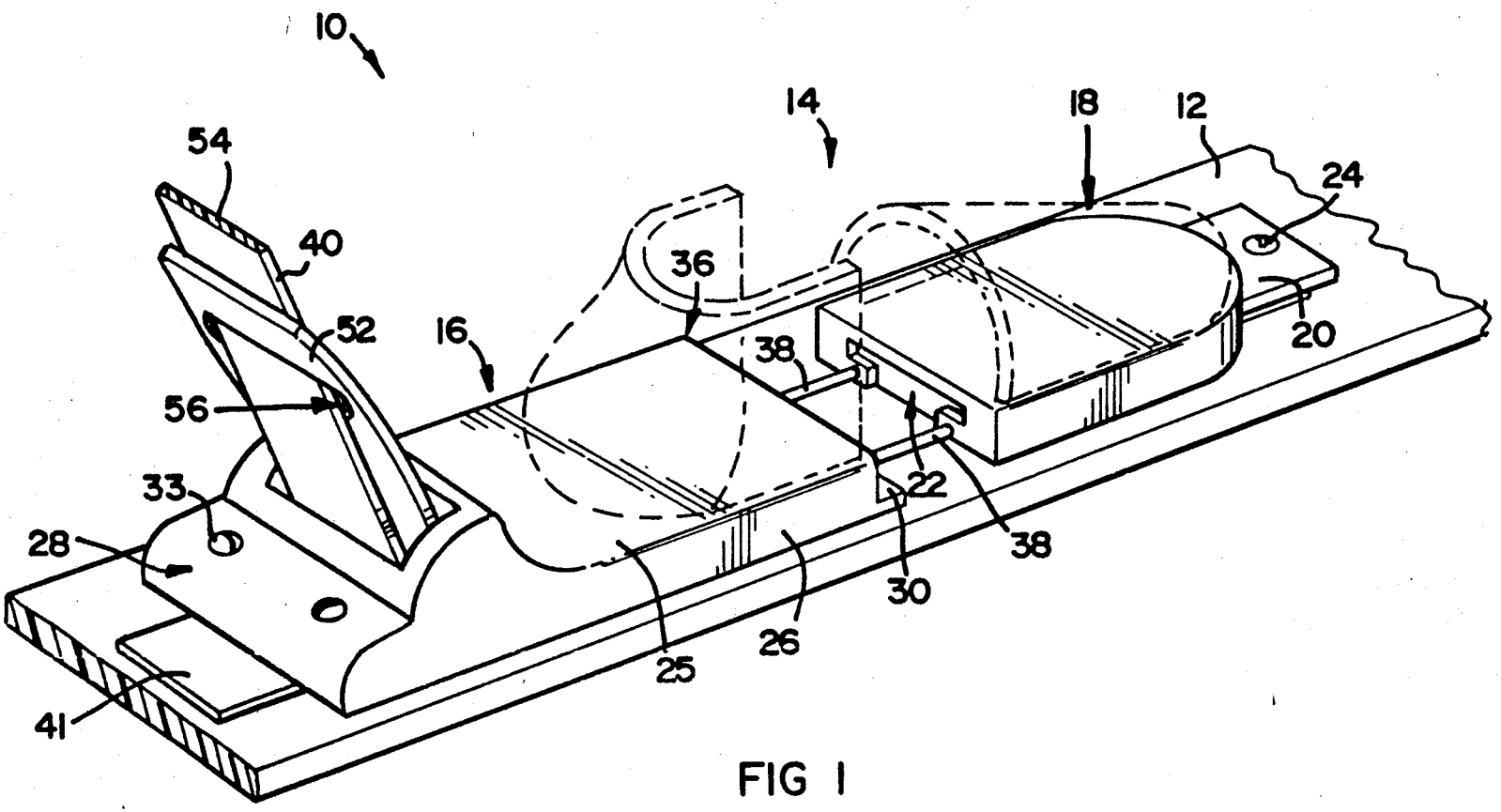
FIG. 1 is a three-dimensional view of a first embodiment of a ski, in accordance with the invention.
Figure 2:
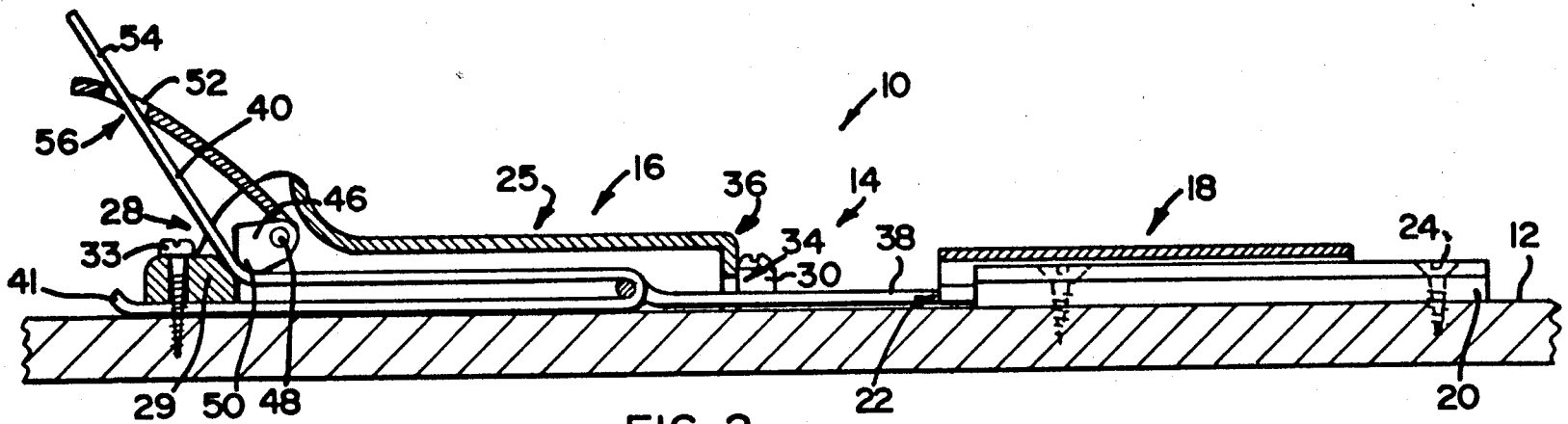
FIG. 2 is a sectional side view of the ski of FIG. 1.

Referring initially to FIGS. 1 and 2 of the drawings only, reference numeral 10 refers generally to a water ski, in accordance with the invention.

The ski 10 comprises an elongate planing body 12 and a footpiece 14 for locating a skier's foot on the planing body 12. The footpiece 14 is mounted on the upper surface of the planing body 12 about midway along its length.

The footpiece 14 comprises a foot locating member made up of a fixedly secured foot locating portion 16, which is formed to receive the heel part of a skier's foot therein and which is fixedly mounted on the planing body 12 and a slidingly located foot locating portion 18, which is formed to receive the ball and toe part of a skier's foot therein and which is slidingly displaceable along the planing body 12. For the sake of clarity the upper parts of the two foot locating portions 16 and 18 are not shown in FIG. 2 and are merely shown in dotted lines in FIG. 1, from which it is clear that these upper parts together with the base parts of the foot locating portions provide for the location of the parts of a skier's foot as described above. Both these upper parts of the foot locating portions are of a suitable rubber, or the like.

The slidingly located foot locating portion 18 is slidingly displaceable along guide means, the guide means comprises a guide rail 20 having a T-shaped cross-section for engaging a complementary channel 22, also T-shaped in cross-section, on the underside of the slidingly located foot locating portion 18. The guide rail 20 is fixedly mounted on the upper surface of the planing body 12 by a number of screws 24 spaced apart along the guide rail 20 and countersunk into the upper surface of the guide rail 20, the screws penetrating into the planing body 12. It is anticipated that the guide rail 20 also may be in one piece with the fixedly secured foot locating portion 16.

The fixedly secured foot locating portion 16 includes a substantially planar body 25 spaced above and parallel with the upper surface of the planing body 12. The body 25 is held in fixed spaced relation to the planing body 12 by a web 26 disposed around three sides of the body, the rear 28 of the heel locating portion not being provided with a web. The front end of the web, i.e. opposite to the slidingly located foot locating portion 18, is provided with a flange 30 for securing the fixedly secured foot locating portion 16 to the planing body 12, the flange 30 having screws 32 penetrating therethrough into the planing body 12. At the rear 28 of the fixedly secured foot locating portion 16 remote from the slidingly located foot locating portion 18, the body 25 curves upwardly along its edge and provides a solid body 29. This solid body 29 is provided with holes through which further screws 33 serve to secure the fixedly secured foot locating portion 16 to the planing body 12. The fixedly secured foot locating portion 16 has a slot aperture 34 in the web 26 at the end 36 nearest the slidingly located foot locating portion 18.

At the end of the slidingly located foot locating portion 18 closest to the fixedly secured foot locating portion 16, a yoke 38 protruding laterally outwardly from the slidingly located foot locating portion is mounted on the slidingly located foot locating portion 18, preferably from a point corresponding to the lower part of the T-shaped channel 22. The yoke 38 protrudes through the slot aperture 34 in the fixedly secured foot locating portion 16.

A flat strap 40 is provided, threaded through the yoke 38, one end 41 of the flat strap 40 being fixedly secured to the planing body 12, via screws 33, which also secure the fixedly secured foot locating portion 16 to the planing body 12.

The locking means for releasably locking the strap 40 thereto is provided in the space between the body 25 of the fixedly secured foot locating portion 16, the upper surface of the planing body 12 and the surface of the solid body 29 at the rear.

The locking means comprises a cam 46 rotatably mounted on a shaft 48. The cam 46 is provided with an eccentric formation 50 so that when the formation 50 is rotated towards the surface of the solid body 29 of the fixedly secured foot locating portion 16, the formation 50 will be closely spaced from said surface. A lever 52 is provided fast with the cam 46 projecting upwardly outwardly therefrom, so that when the lever 52 is pivoted about its axis, it will cause rotation of the cam 46.

As described above, the strap is threaded through the yoke 38 with one end 41 being fixedly secured to the planing body 12.

The other end of the strap 40 is threaded through the locking means described above, in the space between the cam 46 and said lower surface. The lever 52 has an aperture 56 towards an upper end thereof through which the straps 40 also is threaded.

In use, the foot of person proposing to use the ski 10 will be inserted into the footpiece 14. To achieve this, however, the slidingly located foot locating portion 18 will have to be displaced a sufficient distance from the fixedly secured foot locating portion 16. Once the foot has been inserted, the said other end 54 of the strap 40 passing out of the rear 28 of the fixedly secured foot locating portion 16 is gathered in, drawing the slidingly located foot locating portion 18 towards the fixedly secured foot locating portion 16 and gripping the foot with a snug fit. Tension may be applied to the strap 40 to ensure that the foot is gripped sufficiently tightly.

The strap 40 is then releasably locked in position to hold the foot tightly for the desired period by moving the lever 52 downwardly, thereby to rotate the cam 46 and bring the eccentric formation 50 on the cam 46 into close proximity to the surface of the solid body 29 of the body 25 of the fixedly secured foot locating portion 16, thereby to grip the strap 40 with a friction hold.

When it is required to remove the foot of a person using the ski 10 from the footpiece 14, i.e. after the skiing has been completed, the strap 40 is released. This is achieved by raising the lever by manipulation of the strap 40, thereby displacing the eccentric formation 50 on the cam 46 away from the surface of the solid body 29 and releasing the strap 40 from being gripped by said eccentric formation 50 and said surface. Once the strap is loosened, the slidingly located foot locating formation 18 can be urged by hand away from the fixedly secured foot locating portion 16, thereby freeing the skier's foot.

Figure 3:
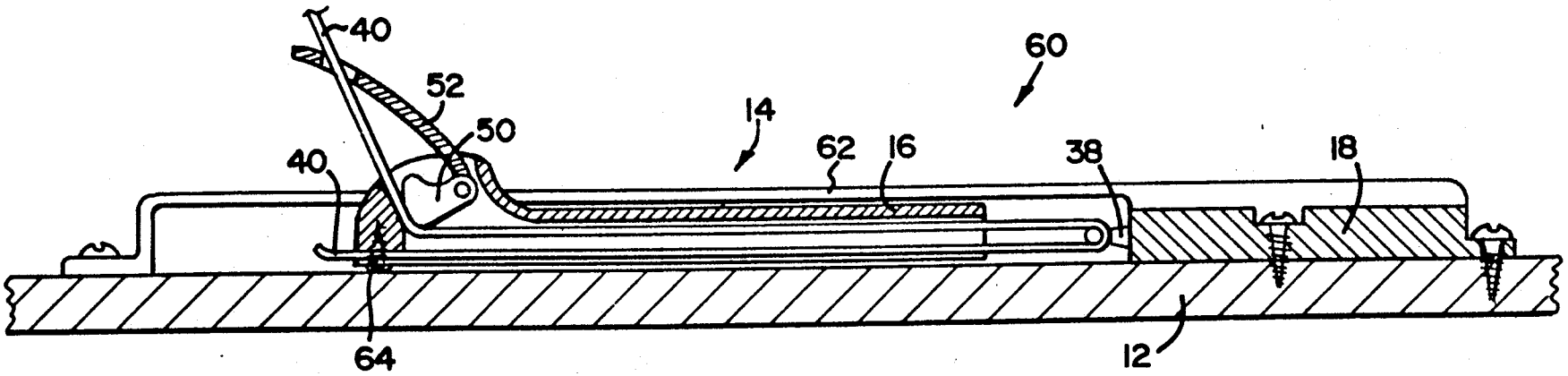
FIG. 3 is a sectional side view of a second embodiment of a ski, in accordance with the invention.

By a suitable adaptation, it is also possible to arrange that the foot locating portion for locating the heel of a skier's foot be the movable portion and the foot locating portion for locating the toe and ball part of a skier's foot, be the fixedly secured foot locating portion. This is illustrated clearly in FIG. 3 of the drawings in which equivalent parts are indicated by the same reference numerals as before.

In this embodiment of the invention the planing body 12 of the ski, generally indicated by the reference numeral 60, has the foot locating portion 18, which is provided for locating the toe and ball part of a skier's foot therein, fixedly secured thereto by means of suitable screws as shown. The foot locating portion 16, which is provided for locating the heel part of a skier's foot therein, is slidingly located within a guide structure 62, defining guide channels on opposite sides of the foot locating portion 16, within which opposite sides of the foot locating portion 16 can be slidingly located in order to permit its displacement relative to the foot locating portion 18.

In this embodiment of the invention, the elongate strap 40 for displacing the foot locating portion 16 again engages a yoke 38 mounted on the foot locating portion 18, but in this embodiment the end 41 of the strap 40 is fixedly secured to the foot locating portion 16 by means of a screw 64 as shown. With the overall configuration of the locking means including the cam 50 and lever 52 essentially being equivalent as before, by applying a tensile force to the strap 40, the foot locating portion 16 will be drawn towards the fixed foot locating portion 18 to thereby adjust the effective size of the footpiece for the same purpose as above described. As the remaining features of the ski 16 including the footpiece 14 is equivalent to that of the ski 10, this is not described in any further detail herein.

The Applicant believes that his invention provides a footpiece for a ski capable of fitment to a wide range of feet sizes. Furthermore, the Applicant believes that the invention will provide a footpiece easy to use and easy to fit the skier's foot, especially without assistance when the skier is in water.

We claim:

1. A footpiece for locating a skier's foot on a water ski, wherein said footpiece comprises:

(a) a foot locating member including a first foot locating portion formed to receive the heel part of a skier's foot therein and a second foot locating portion formed to receive the ball and toe part of a skier's foot therein, one foot locating portion having attachment means for fixedly securing it to the ski, while the other foot locating portion is slidingly located relative to the ski, so that by sliding displacement of the slidingly located foot locating portion different sized skier's feet can be accommodated by the foot locating member;

(b) guide means for guiding sliding displacement of the slidingly located foot locating portion relative to the ski; ;and (c) a flexible elongated strap element operatively coupled to the slidingly located foot locating portion and a locking means, said flexible elongated strap element extending away from said slidingly located foot locating portion and said locking means, and defining a free end so that a tensile force can be manually applied to said flexible elongate strap element by acting upon its free end, which force can be transmitted to said slidingly located foot locating portion for slidingly displacing said slidingly located foot locating portion relative to the ski and which force manipulates said locking means.

2. A footpiece as claimed in claim 1, which includes a yoke secured to the slidingly located foot locating portion and in which the elongate element is threaded through an engagement opening defined by the yoke with one end of the element fixedly anchored relative to the ski and the other end of the element being disposed so that by applying a tensile force thereon the slidingly located foot locating portion can be displaced thereby.

3. A footpiece as claimed in claim 1, which includes a yoke secured to the fixedly secured foot locating portion and in which the elongate element is threaded through an engagement opening defined by the yoke with one end of the element fixedly anchored on the slidingly located foot locating portion and the other end of the elongate element being disposed so that by applying a tensile force thereon the slidingly located foot locating portion can be displaced thereby.

4. A footpiece as claimed in claim 1, in which the locking means can lock the slidingly located foot locating portion in a required position relative to the ski by locking the flexible elongate element relative thereto.

5. A footpiece as claimed in claim 4, in which the locking means comprises a body portion defining an engaging formation and a cam rotatably mounted on a shaft and having an eccentric formation with respect to the shaft, the configuration between the engaging formation and the eccentric formation of the cam being such that the flexible elongate element can pass between them and by rotation of the cam, the eccentric formation is displaceable between a first angular position in which the elongate element is freely displaceable between the engaging formation and the eccentric formation and a second angular position in which the elongate element is locked between them.

6. A footpiece as claimed in claim 5, in which the body portion defining the engaging formation is part of the fixedly secured foot locating portion and the cam formation is rotatably mounted on the same foot locating portion.

7. A footpiece as claimed in claim 5, in which the body portion defining the engaging formation forms part of the displaceable foot locating portion and the cam formation is rotatably mounted on the same foot locating portion.

8. A footpiece as claimed in claim 5, in which the locking means includes a lever fast with the cam for rotating the cam about its shaft.

9. A footpiece as claimed in claim 8, in which the lever has an aperture therethrough through which the flexible elongate element can be threaded so that, in use, the cam can be rotatably displaced between its first and second angular positions by suitable manipulation of the flexible elongate element.

10. A footpiece as claimed in claim 1, in which the guide means comprises a guide rail that is engaged by the slidingly located foot locating portion via a formation defined by the slidingly located foot locating portion that is complementary to the cross-sectional profile of the guide rail.

11. A footpiece as claimed in claim 10, in which the guide rail has a T-shaped cross-sectional profile and the slidingly located foot locating portion defines a channel formation having a complementary profile to provide for sliding engagement of the slidingly located foot locating portion with the guide rail.

12. A water ski comprising a planing body and a footpiece for locating a skier's foot on the planing body, wherein said footpiece comprises:

(a) a foot locating member including a first foot locating portion formed to receive the heel part of a skier's foot therein and a second foot locating portion formed to receive the ball and toe part of a skier's foot therein, one foot locating portion being fixedly secured to the planning body of the ski, while the other foot locating portion is slidingly locating relative to the planing body of the ski, so that by sliding displacement of the slidingly located foot locating portion different sized skiers' feet can be accommodated by the foot locating member;

(b) guide means for guiding sliding displacement of the slidingly located foot locating portion relative to the planing body of the ski; and (c) a flexible elongated strap element operatively coupled to the slidingly located foot locating portion and a locking means, said flexible elongated strap element extending away from said slidingly located foot locating portion and said locking means, and defining a free end so that a tensile force can be manually applied to said flexible elongate strap element by acting upon its free end, which force can be transmitted to said slidingly located foot locating portion for slidingly displacing said slidingly located foot locating portion relative to the planing body of the ski and which force manipulates said locking means.

13. A ski as claimed in claim 12, in which the footpiece includes a yoke secured to the slidingly located foot locating portion and in which the elongate element is threaded through an engagement opening defined by the yoke with one end of the element fixedly anchored relative to the planing body of the ski and the other end of the element being disposed so that by applying a tensile force thereon the slidingly located foot locating portion can be displaced thereby.

14. A ski as claimed in claim 12, in which the footpiece includes a yoke secured to the fixedly secured foot locating portion and in which the elongate element is threaded through an engagement opening defined by the yoke with one end of the element fixedly anchored on the slidingly located foot locating portion and the other end of the elongate element being disposed so that by applying a tensile force thereon the slidingly located foot locating portion can be displaced thereby.

15. A ski as claimed in claim 12, in which the locking means can lock the slidingly located foot locating portion in a required position relative to the planing body of the ski by locking the flexible elongate element relative thereto.

16. A ski as claimed in claim 15, in which the locking means comprises a body portion defining an engaging formation and a cam rotatably mounted on a shaft and having an eccentric formation with respect to the shaft, the configuration between the engaging formation and the eccentric formation being such that the flexible elongate element can pass between them and by rotation of the cam the eccentric formation is displaceable between a first angular position in which the elongate element is freely displaceable between the engaging formation and the eccentric formation and a second angular position in which the elongate element is locked between them.

17. A ski as claimed in claim 16, in which the body portion defining the engaging formation as part of the fixedly secured foot locating portion and the cam formation is rotatably mounted on the same foot locating portion.

18. A ski as claimed in claim 16, in which the body portion defining the engagement formation forms part of the displaceable foot locating portion and the cam formation is rotatably mounted on the same foot locating portion.

19. A ski as claimed in claim 16, in which the locking means includes a lever fast with the cam for rotating the cam about its shaft.

20. A ski as claimed in claim 19, in which the lever has an aperture therethrough through which the flexible elongate element can be threaded so that, in use, the cam can be rotatably displaced between its first and second angular position by suitable manipulation of the flexible elongate element.

21. A ski as claimed in claim 12 in which the guide means comprises a guide rail that is engaged by the slidingly located foot locating portion via a formation defined by the slidingly located foot locating portion that is complementary to the cross-sectional profile of the guide rail.

22. A ski as claimed in claim 21, in which the guide rail has a T-shaped cross-sectional profile and the slidingly located foot locating portion defines a channel formation having a complementary profile to provide for sliding engagement of the slidingly located foot locating portion with the guide rail.

* * * * *

UNITED STATES PATENT AND TRADEMARK OFFICE

CERTIFICATE OF CORRECTION

PATENT NO. : 5,199,915

DATED : April 6, 1993

INVENTOR(S) : Bindon et al

It is certified that error appears in the above-identified patent and that said Letters Patent is hereby corrected as shown below:

Column 7, line 26, change "locating" to -- located --.

Signed and Sealed this

Seventh Day of December, 1993

*Attest:*

*Attesting Officer*

BRUCE LEHMAN

*Commissioner of Patents and Trademarks*